United States Patent [19]

Bosworth

[11] Patent Number: 4,643,244

[45] Date of Patent: Feb. 17, 1987

[54] GAS-LIQUID HEAT EXCHANGE PROCESS AND APPARATUS

[75] Inventor: Robert T. Bosworth, Wilmington, Del.

[73] Assignee: E. I. Du Pont de Nemours and Company, Wilmington, Del.

[21] Appl. No.: 847,149

[22] Filed: Apr. 2, 1986

Related U.S. Application Data

[63] Continuation of Ser. No. 668,972, Nov. 7, 1984, abandoned.

[51] Int. Cl.[4] ..... F28D 1/00

[52] U.S. Cl. ..... 165/1; 165/158; 165/159

[58] Field of Search ..... 165/158, 159, DIG. 8, 165/157

[56] References Cited

U.S. PATENT DOCUMENTS

| | | | |
|---|---|---|---|
| 3,132,123 | 5/1964 | Harris, Jr. et al. | 526/247 |
| 3,228,456 | 1/1966 | Brown et al. | 165/134 R |
| 3,228,876 | 1/1966 | Mahon | 210/321.3 |
| 3,315,740 | 4/1967 | Withers | 165/172 |
| 3,363,680 | 1/1968 | Baker | 165/158 |
| 3,435,893 | 4/1969 | Withers | 165/158 |
| 3,718,181 | 2/1973 | Reilly et al. | 165/180 |
| 3,804,160 | 4/1974 | Kendrick | 165/145 |
| 3,863,712 | 2/1975 | Smith | 165/145 |
| 4,224,982 | 9/1980 | Frei | 165/159 |

*Primary Examiner*—William R. Cline
*Assistant Examiner*—Richard R. Cole

[57] ABSTRACT

Process and apparatus for the changing the temperature of a gaseous stream using flexible fluoropolymer tubes having specified dimensions and configurations. The tubes are separated by spaces which serve the dual purpose of regulating the free span of each tube segment between spacers at a distance of about 20 to 90 cm and separating successive rows of tubes by about 1.25 to 3.0 times the diameter of the tubes. This configuration permits a low frequency, high amplitude vibration of the tubes that has the dual effect of a self-cleaning function and an increase in the heat transfer coefficient of the tubes.

14 Claims, 5 Drawing Figures

GAS-LIQUID HEAT EXCHANGE PROCESS AND APPARATUS

This application is a continuation of application Ser. No. 668,972, filed 11-7-84, now abandoned.

BACKGROUND OF THE INVENTION

A wide variety of heat exchange apparatus has been used for treatment of exit gases from process streams, particularly those containing corrosive elements such as combustion gases. Such combustion gases typically contain oxides of sulfur and nitrogen that can form highly corrosive acids. These acids have restricted the materials that can be used in heat exchange apparatus when the gas is cooled below its dew point. To compensate for the highly corrosive nature of such gases, heat exchange elements have, in the past, been prepared from glass, copper, and copper covered with fluoropolymer. Moreover, highly structured arrangements of fluoropolymer tubes have been suggested, such as in Withers U.S. Pat. No. 3,435,893.

When recovering heat from exit gases resulting from combustion processes, a continuing difficulty is encountered in the balance between heat transfer efficiency and pressure drop in the gas stream. Accordingly, a continuing need exists for a heat exchange apparatus for gas streams combining a corrosion resistant material with a configuration that provides good heat transfer efficiency with minimum pressure drop.

SUMMARY OF THE INVENTION

The instant invention provides, in a process for changing the temperature of a gaseous stream by passing the stream through a heat exchanger maintained at a temperature different from that of the gaseous stream by circulating a heat transfer medium through the heat exchanger, the improvement wherein the heat exchanger comprises a bank of fluoropolymer tubes having a diameter of about from 3 to 10 mm and a free span for each tube segment of about from 20 to 90 cm; the gaseous stream is passed across at least five rows of tubes through which the heat transfer medium is circulated; the tubes are arranged to provide center to center spacing between the tubes of about from 1.25 to 3.0 times the diameter of the tubes; the gaseous stream has a velocity to provide a Reynolds number, through the bank of tubes, of about from 800 to 3000; and wherein the ratio of free span to tube diameter is about from 50 to 150.

The present invention further provides, in an apparatus for changing the temperature of a gaseous stream having a given velocity comprising a passage and a heat exchanger positioned transverse to the passage, the improvement wherein the heat exchanger comprises a bank of tubes of fluoropolymer having a diameter of about from 3 to 10 mm and a free span for each tube segment of about from 20 to 90 cm; the passage intersects at least five rows of tubes; through which a heat transfer medium is circulated; the tubes are arranged to provide center to center spacing between the tubes of about from 1.25 to 3.0 times the diameter of the tubes; and wherein the ratio of the free span to the tube diameter is about from 50 to 150; the parameters being selected to provide a Reynolds number through the bank of tubes of about from 800 to 3000 at the velocity of the gaseous stream.

DETAILED DESCRIPTION OF THE INVENTION

Figure 1:
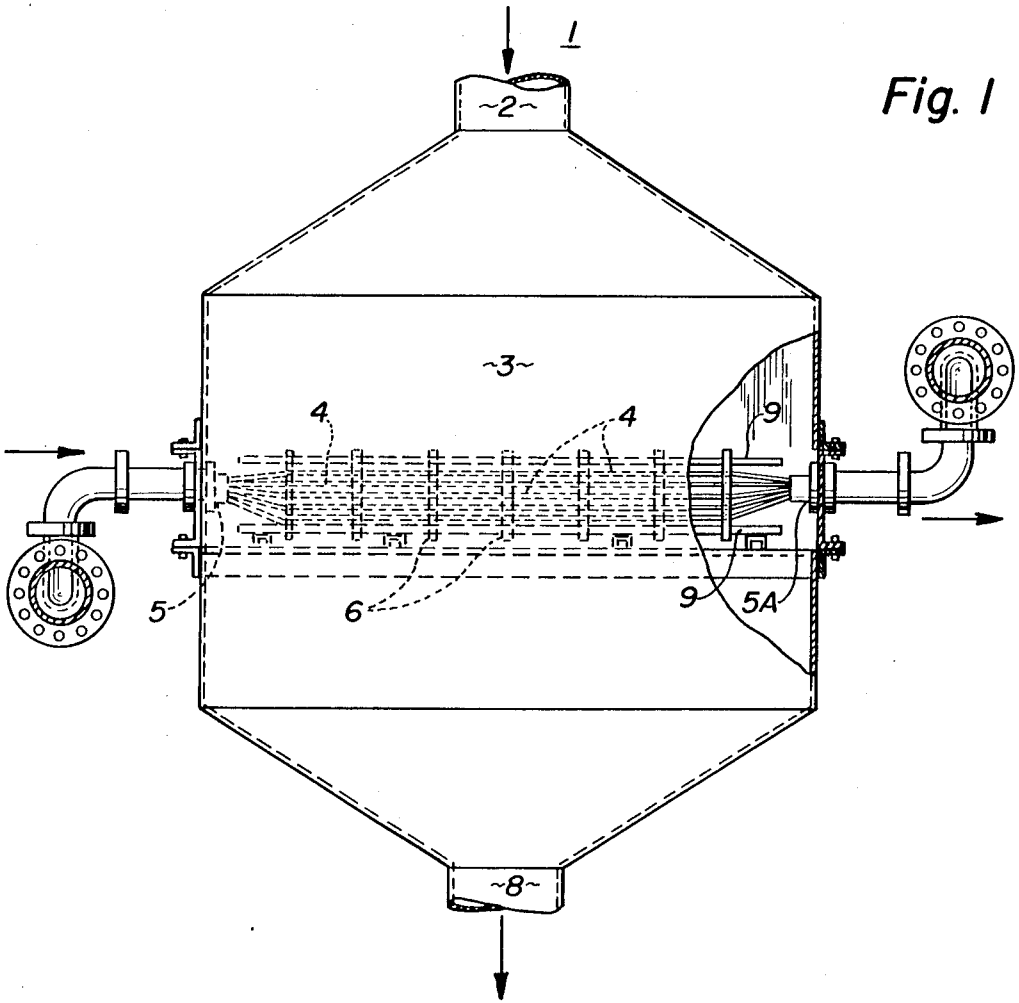
FIG. 1 is a cross-sectional view of a heat exchange apparatus according to the present invention.

The present invention is illustrated in FIG. 1, in which gaseous stream 1 is passed into a heat exchanger through inlet 2 and expanded section 3. Tubes 4 in the heat exchanger extend from tube sheets 5 and 5A positioned at either end of the tubes. The tubes are separated by spacers 6, which serve the dual purpose of regulating the free span of each tube segment between spacers at a distance of about from 20 to 90 cm, and separating successive rows of tubes by about from 1.25 to 3.0 times the diameter of the tubes. After passing through the heat exchanger, the gaseous stream continues through outlet 8.

Figure 2:
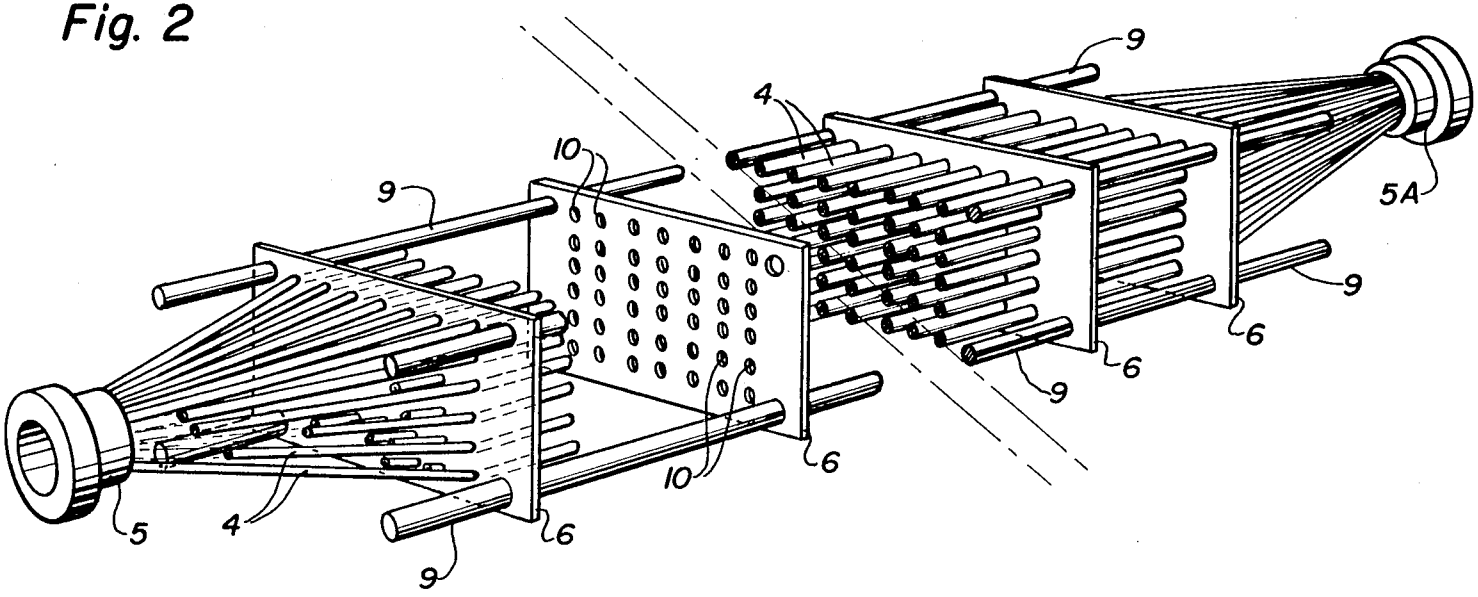
FIG. 2 is a perspective view of a tube bundle which can be used in the apparatus shown in FIG. 1.

It has been found that the free span for each tube segment of about from 20 to 90 cm permits a low frequency, high amplitude vibration of the tubes that has the dual benefit of a self-cleaning function and an increase in the heat transfer coefficient of the tubes. The tubes and spacers can be better seen in FIG. 2, wherein spacers 6 are used in conjunction with rods 9 to maintain the desired free length between spacers. The tubes pass through apertures 10 formed in the spacers The spacers form arrays of at least five rows of tubes in the direction of flow, which can be arranged in any desired configuration, including, for example, a square configuration, as shown, or a triangular configuration. In general, the square configuration provides lower pressure drop in the gaseous stream, while the triangular configuration results in higher heat transfer.

The polymeric tubes can be prepared from a wide variety of fluoropolymers, which have been found to give a combination of desirable heat transfer properties, resistance to the corrosive effects of the gaseous stream, and excellent resistance to fouling. Particularly desirable are polymers of tetrafluoroethylene, copolymers of tetrafluoroethylene and hexafluoropropylene as described in U.S. Pat. No. 2,946,763 and copolymers of tetrafluoroethylene and perfluoropropyl vinyl ether as described in U.S. Pat. No. 3,132,123. Still other fluoropolymers which can be used in the present invention include polyvinylidene difluoride and copolymers of polytetrafluoroethylene and chlorotrifluoroethylene.

In addition, conductive particles can be incorporated in the fluoropolymer for further improved heat transfer characteristics, as described in Reilly et al. U.S. Pat. No. 3,718,181, hereby incorporated by reference. Graphite particles are particularly preferred.

The tube sheets used at the end of the heat exchange units can be prepared by techniques known in the art, such as described in Withers U.S. Pat. No. 3,315,740, also hereby incorporated by reference.

In the operation of the heat exchange apparatus, water or equivalent heat transfer fluid is circulated through the heat exchanger while a gas stream is concurrently passed across the heat exchange tubes. The Reynolds number of the gaseous stream through the bank of tubes is about from 800 to 3000 and preferably about from 1000 to 2000. The Reynolds number is calculated, as is known in the art, as the velocity of flow through the tube bank based on the minimum cross-sectional free area, times the tube diameter times the gas density divided by the gas viscosity. The required Reynolds number can be attained by adjustment of the velocity of the gas entering the tube bank, or adjustment of the size and spacing of the tubes, or both.

While the improved heat transfer of the present invention is not fully understood, it is believed that at Reynolds numbers of less than about 800, and within the other design restrictions, the air velocities are too low to cause any movement of the flexible tubes so that they behave as if they were rigid. As the air velocity increases, the tubes begin to flutter and move from side to side as well as behind one another, which promotes eddy currents, causing an increase in the rate of heat transfer between the tube wall and the gas stream. The energy required to create this movement exhibits itself as a higher pressure drop for the bundle than would be realized with a similar bank of rigid tubes.

As the velocity of the gaseous stream increases further, the pressure drop and heat transfer rate increase until the flow becomes turbulent at a Reynolds number of about 3000.

It is this vibration, that results from the material, dimensional and velocity limitations of the present invention, that provides a heat transfer rate that is greater than would normally be expected from heat exchangers of rigid tubes.

The gaseous stream that is heated or cooled according to the present invention can contain a variety of corrosive elements, including oxides of sulfur and nitrogen that can form corrosive acids. The temperature of the gas stream should be about from 80° to 240° C. Temperatures in excess of 240° C. can adversely effect the fluoropolymer tubes, while little practical benefit is attained in the treatment of gas streams below 80° C., since reduction of gas temperature significantly below this level reduces its natural tendency to rise.

The present invention is further illustrated by the following specific examples.

EXAMPLES AND COMPARATIVE EXAMPLES

A test bundle of about 650 hollow flexible tubes of tetrafluoroethylene/perfluorovinyl ether copolymer was made by stringing tubing through holes in the top and bottom of a clear acrylic box which was 46 cm high and 46 cm wide. The tubes had a diameter of 4.75 mm and were threaded through spacers of the same clear acrylic resin inside the test box such that these spacers could be removed to the top of the test chamber out of the way of the air stream or be placed along the vertical length of the tubes to provide a free span for each tube segment of from 15 to 46 cm. The tubes were arranged in a square hole layout. Heat exchange elements were prepared with 20 rows of tubes. The tubes were spaced at a distance of about 2.0 times the tube diameter. The ends were bonded together to form a tube sheet as described in U.S. Pat. No. 3,315,740.

The module was placed in a wind tunnel and pressure drop measurements were made at air velocities corresponding to Reynolds numbers ranging from about 400 to about 10,000.

After installation in the wind tunnel, a steam line was attached to the top tube sheet such that up to 30 psig saturated steam could be introduced into the tube bank to heat the air. The condensed steam leaving the tube bank was discharged through a trap to the drain. Pressure, flow and temperature measurements were taken such that the overall heat transfer coefficient and pressure drop across the tube bank could be determined at various air velocities.

Pressure measurements were taken with an inclined manometer (oil density=829 kg/m$^3$). Air velocity across the tube bank was measured with an industrial anemometer which was calibrated against a DISA scientific constant temperature anemometer. The heat flow from the tubes to the air was determined by measuring the temperature of the air stream before and after the heat exchange module with J-type thermocouples. Heating steam pressures of 7 and 15 psig were used. The air velocity was varied over a range to cover the laminar, transitional and turbulent flow regimes.

The pressure drop was calculated as dimensionless numbers according to the following equation:

$$f = \frac{2\,\Delta_p}{N\,V^2 P}$$

where $\Delta_p$ is pressure drop, pascals

N is number of tube rows in the direction of flow

P is air density, kg/m$^3$

V is air velocity, m/sec, based on the minimum cross-section in the tube bundle

The overall heat transfer coefficient, $U_o$, was determined experimentally at each condition and was then used to back calculate $h_o$, the outside air film coefficient, by the following equations:

$$Q = U_o A\,(LMTD) = WC_p\,\Delta T$$

$$U_o = \frac{1}{\frac{1}{h_o} + \frac{k_w}{t_w} + \frac{D_o}{D_i h_i}}$$

where

A is a heat transfer area in m$^2$

LMTD is log-mean temperature difference, °C.

W is air mass flow kg/hr.

Cp is air heat capacity, kcal/hr −°C.

ΔT is difference of air temperature in and out of tube bank k is tube wall thermal conductivity $t_w$ is wall thickness $D_o$, $D_i$ is outside and inside tube diameter $h_i$ is inside film coefficient calculated by known engineering correlations.

Consistent SI units are used for all of the above calculations.

The outside film coefficient, $h_o$, is expressed a dimensionless number $J_b$ $$J_b = \frac{h_o D_o}{k_{air}} \times (Pr)^{-\frac{1}{3}} \left(\frac{\mu_w}{\mu}\right)^{-.14}$$

Figure 3:
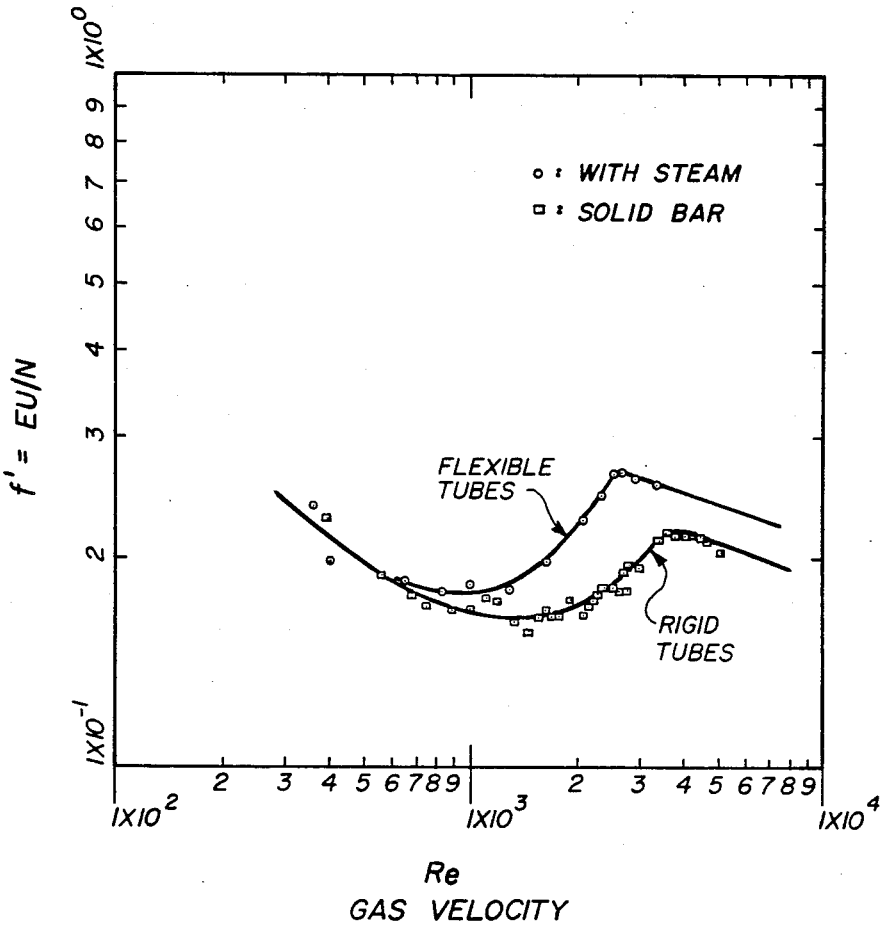
FIG. 3 is a graphical illustration of the relationship between pressure drop and gas velocity in heat exchange apparatus of the present invention, compared to a similar heat exchanger having rigid tubes.
Figure 4:
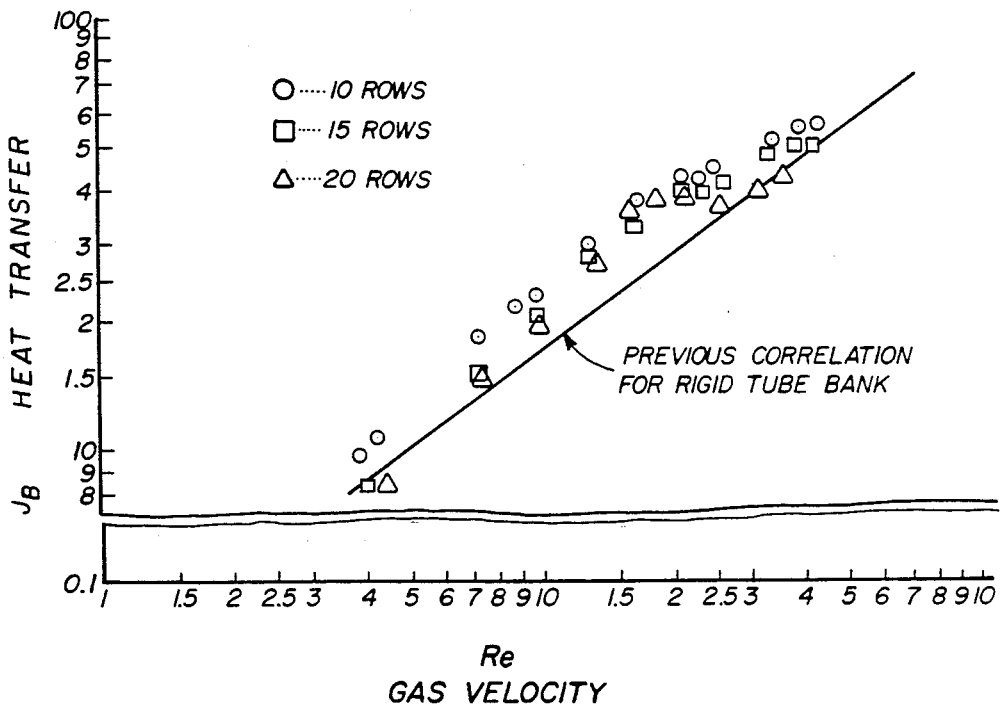
FIGS. 4 and 5 are graphical illustrations of the relationship between heat transfer and gas velocity in heat exchange apparatus of the present invention and the importance of the free span length of the tubes.
Figure 5:
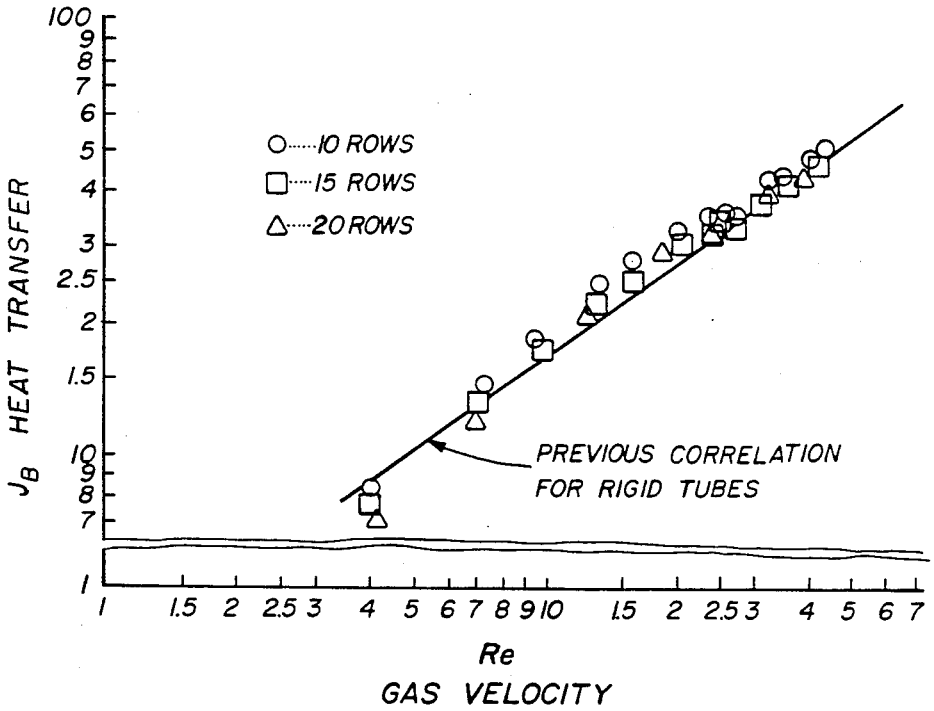

Both f' and $J_b$ are presented in FIGS. 3, 4 and 5 as a function of the Reynolds number, Re.

$Re=(D_oVP/\mu)$

Vibrations of the tubes were observed when the Reynolds number of the air flow was more than about 800. The amplitude of vibration was visibly large and exceeded two tube diameters in many cases.

The test results are summarized in FIGS. 3–5. Both the observed pressure drop and heat transfer rate across the bank of vibrating tubes is higher than predicted by literature correlations based on rigid metal tubes, in the transition region (Re=800–3000).

We claim:

1. In a process for changing the temperature of a gaseous steam by passing the stream through a heat exchanger maintained at a temperature different from that of the gaseous stream by circulating a heat transfer medium through the heat exchanger, the improvement which comprises passing said gaseous stream through said heat exchanger in a direction transverse to a bank of fluoropolymer tubes in the heat exchanger, said tubes having a diameter of from about 3 to 10 mm and a free span for each tube segment of from about 20 to 90 cm, the ratio of free span to tube diameter being from about 50 to 150, passing the gaseous stream across at least five rows of said tubes while circulating a heat transfer medium through said tubes, said tubes being arranged to provide center to center spacing between the tubes of from about 1.25 to 3.0 times the diameter of the tubes, maintaining the gaseous stream at a velocity to provide a Reynolds number through the bank of tubes of from about 800 to 3000 whereby a low frequency, high amplitude vibration is set up in said tubes.

2. A process of claim 1 wherein the fluoropolymer is a copolymer of tetrafluoroethylene and hexafluoropropylene.

3. A process of claim 1 wherein the fluoropolymer is a copolymer of tetrafluoroethylene and perfluoropropyl vinyl ether.

4. A process of claim 1 wherein the tubes further comprise from about 5 to 45 weight percent of filler particles having substantially higher thermal conductivity than the fluoropolymer.

5. A process of claim 4 wherein the conductive filler particles are graphite.

6. A process of claim 1 wherein the free span for each tube segment is about from 40 to 65 cm.

7. A process of claim 1 wherein the tube diameter is about from 4.0 to 6.5 mm.

8. In an apparatus for changing the temperature of a gaseous stream having a given velocity comprising an inlet for introducing said gaseous stream into said passage and an outlet therefor, and a heat exchanger positioned therein, the improvement wherein the inlet and outlet are positioned on opposite sides of said heat exchanger to provide a flow for said gaseous stream transverse to said heat exchanger, said heat exchanger comprising a bank of fluoropolymer tubes having a diameter of from about 3 to 10 mm and a free span for each tube segment of from about 20 to 90 cm, the passage intersecting at least ten rows of tubes through which a heat transfer medium is circulated, the tubes being arranged to provide center to center spacing between the tubes of from about 1.25 to 3.0 times the diameter of the tubes, and wherein the ratio of the free span to the tube diameter is from about 50 to 150, the parameters being selected so as to provide a Reynolds number through the bank of tubes of from about 800 to 3000 at a selected velocity for the gaseous stream and to permit a low frequency, high amplitude vibration to be set up in said tubes.

9. An apparatus of claim 8 wherein the fluoropolymer is a copolymer of tetrafluoroethylene and hexafluoropropylene.

10. An apparatus of claim 8 wherein the fluoropolymer is a copolymer of tetrafluoroethylene and perfluoropropyl vinyl ether.

11. An apparatus of claim 8 wherein the tubes further comprise from about 5 to 45 weight percent of filler particles having substantially higher thermal conductivity than the fluoropolymer.

12. An apparatus of claim 11 wherein the conductive filler particles are graphite.

13. An apparatus of claim 11 wherein the free span for each tube segment is from about 40 to 65 cm.

14. An apparatus of claim 11 wherein the tube diameter is from about 4.0 to 6.5 mm.

* * * * *